United States Patent [19]

Brun

[11] Patent Number: 4,961,688

[45] Date of Patent: Oct. 9, 1990

[54] PROCESS AND APPARATUS FOR PUMPING AND METERING A LIQUID PRODUCT WITH A MELTING POINT BETWEEN 200 AND 350 DEGREES C.

[75] Inventor: Pierre Brun, Grenoble, France

[73] Assignee: Compagnie Europeene du Zirconium Cezus, Courbevoie, France

[21] Appl. No.: 294,409

[22] Filed: Jan. 9, 1989

[30] Foreign Application Priority Data

Jan. 21, 1988 [FR] France ..... 88 01007

[51] Int. Cl.[5] ..... F04B 19/04

[52] U.S. Cl. ..... 417/92; 417/55; 417/99

[58] Field of Search ..... 417/55, 92, 99

[56] References Cited

U.S. PATENT DOCUMENTS

| | | | |
|---|---|---|---|
| 755,722 | 3/1904 | Stroh | 417/92 |
| 1,342,798 | 6/1920 | Farrand | 417/99 |
| 2,950,856 | 8/1960 | Feichtinger | 417/99 |
| 3,235,348 | 2/1966 | Witcher | 417/99 |
| 3,740,166 | 6/1973 | Seki et al. | 417/92 |
| 3,814,545 | 6/1974 | Waters | 417/92 |
| 4,021,531 | 5/1977 | Besson et al. | 423/492 |
| 4,527,957 | 7/1985 | Dettinger et al. | 417/92 |

*Primary Examiner*—Leonard E. Smith
*Assistant Examiner*—Robert N. Blackmon
*Attorney, Agent, or Firm*—Dennison, Meserole, Pollack & Scheiner

[57] ABSTRACT

The invention relates to a process and apparatus for the pumping and metering of liquid products, wherein the melting point is between 200° and 350° C. In the process, a pulsation generator with piston and diaphragm displaces a thermal fluid which actuates a pumping apparatus, and the fluid transmits its pulsations to a molten tin alloy or tin bath contained in a siphon, the bath in turn transmitting the pulsations to part of the liquid product to be displaced and which is contained in a conduit connecting the siphon to a diaphragm-free pumping head, between the suction valve and delivery valve of the said pumping head, which makes the latter operate in suction and delivery with respect to the same product between suction pipe and delivery pipe. The process and apparatus are particularly applicable to the pumping of melted salts with a melting point between 200° and 350° C. at temperatures between 210° and 380° C.

6 Claims, 1 Drawing Sheet

PROCESS AND APPARATUS FOR PUMPING AND METERING A LIQUID PRODUCT WITH A MELTING POINT BETWEEN 200 AND 350 DEGREES C.

The process and apparatus to the invention are in the field of pumping and dispensing liquid products having a melting point between 200° and 350° C.

DESCRIPTION OF THE PROBLEM

These high melting point products which have to be moved at temperatures between 210° and 380° C. are, e.g., melted salts, such as an alkaline chloroferrate or chloroaluminate containing dissolved hafnium and zirconium tetrachlorides, said salts being used in the process described in FR-C No. 2,250,707, which corresponds to U.S. Pat. No. 4,021,531. For example, potassium chloroalumiate containing more than 25% dissolved Zr and Hf tetrachlorides solidifies at 300° to 305° C., and at a boiling point of approximately 345° C., at atmospheric pressure, so that it has to be pumped in a narrow temperature range of e.g., 315° to 330° C. Industrial exploitation of the process described in FR-C No. 2,250,707 makes it necessary to have a regular and regulatable flow rate, e.g. between 1000 and 4000 l/h. In the general case of pumping liquid products between 210° and 380° C. it is consequently necessary to have regular, regulatable flow rates, a well controlled temperature and also a good sealing of the pumping circuit.

PRIOR ART

Conventional piston or diaphragm positive displacement pumps are not suitable for the present problem, because it is necessary for the entire pumping head, including the piston and the stuffing box, to be at a temperature above the melting point of the product to be displaced. Experience has shown that significant operating difficulties occur as soon as the melting point reaches or exceeds 100° C.

It is then preferable to use a pumping means incorporating a conventional piston or diaphgram pulsation or pulse generator connected by a pipe to a separate pumping head having a diaphragm and preferably a metal diaphragm. An intermediate thermal fluid is moved by the pulsation generator and actuates the pumping head diaphragm, so as to convey the liquid, whose temperature is, e.g., between 100° and 250° C. The spacing of the pumping head makes it possible to obtain a temperature below approximately 100° C. level with the pulsation temperature and a correct operation of the metering pump.

When the liquid product has to be moved at a temperature higher than 200° C. use is generally made of organic thermal fluids, such as diphenyl derivatives. The vapor tensions of said fluids at 300° to 350° C., are often high, ranging e.g., between 0.03 and 0.6 MPa, which limits the suction stroke possibilities of the pumping means using them. The most temperature resistant fluids, given for a maximum temperature of use of 400° C., suffer from the disadvantage of having melting points above ambient temperature and ranging between approximately 70° 145° C. (Techniques de l'Ingenieur, "Fluides Thermiques Organiques", J. Villeneuve J. 2380-2, May 1965), so that they cannot in practice be used.

Moreover, there is a significant expansion of these organic thermal fluids which is approximately 28% for hydrogenated polyphenyl at between 20 and 320° C. The greater the temperature difference between the pulsation generator and the pumping head, the longer the connecting pipe must be and the greater the problems resulting from the expansion of the thermal fluid. A high pulsation frequency leads to equalization of the temperatures, so that difficulties are encountered in remaining at an acceptable temperature in the pulsation generator.

As soon as the pumping temperature exceeds 150° C., it is necessary to use entirely metallic diaphragms in the pumping head. The limited possibilities of flexing the diaphragms make such pumping heads very heavy and bulky as soon as the flow rate exceeds 300 to 500 l/h.

DESCRIPTION OF THE INVENTION

Turning once again to the apparatus of the type described and discussed hereinbefore, the process and apparatus according to the invention have the feature of using in a siphon a low melting point alloy or metal in the molten state in place of the metal diaphragm of the pumping head. Such a metal alloy or metal piston permits pulsations of significant amplitudes and therefore the pumping of liquid products melting between 200° and 400° C. at a high flow rate. During pumping, a conventional pulsation generator displaces a thermal fluid and the latter displaces the molten alloy or metal bath contained in the siphon, which in turn displaces part of the liquid product to be moved contained between suction and delivery valves in a coupling connecting the siphon to the diaphragm-free pumping head. The liquid product pulsations then lead to the operation of the valves with suction and delivery of the liquid product. The pumping means is here constituted by the molten alloy or metal contained in the siphon, the coupling and the pumping head of the diaphragm.

The molten alloy or metal used as the "pulsation liquid" must first be compatible with the melted products to be carried, e.g., sodium and/or potassium chloroferrates or chloroaluminates and mixtures thereof, optionally containing dissolved Zr and Hf tetrachlorides, as in the process described by FR-C No. 2,250,707. In addition, it must not react with the thermal fluid and must not corrode the siphon walls. Finally, the melted alloy or metal must have a melting point well below the temperature of the liquid product to be carried, as well as a low vapor tension at said same temperature and a density well above that of the liquid product and the thermal fluid, so as to remain at the bottom of the siphon and not mix with the liquid product or thermal fluid during the pulsations.

The following comments are made on these low melting point alloys or metals:

Indium melts at 155° C. and boils at 1450° C. at atmospheric pressure. It suffers from the disadvantage of being rare and therefore expensive, and, in the molten state, is more corrosive than tin with respect to a certain number of metals.

Standard purit tin (Sn) melts at 232° C., and boils at approximately 2260° C.; certain tin alloys have melting points below 200° C., and in particular the tin-lead eutectic with 38 % by wieght lead melts at 183 ° C.

Mercury (Hg), which is liquid at ambient temperature, boils at about 370° C. and has a high vapor pressure, namely 0.1 MPa at about 260° C. and 0.25 MPa at about 300° C.

Tin and its alloys Sn-Pb with the Pb% by weight preferably equal to or below 70%, or Sn-Cu alloys with the Cu% by weight preferably below 8% or Sn-Pb-Cu alloys with approximately 70% Pb and 8% Cu are metals and alloys most suitable in connection with the present invention. In the molten state, they have a very low vapor pressure and are inert with respect to organic thermal fluids used between approximately 210 and 450° C. and with respect to many liquid products at these temperatures and especially sodium and/or potassium chloroferrates and chloroaluminates. As molten tin dissolves steel and nickel, in order to have a properly operating siphon over a long period it is necessary to provide an inert coating, such as of chromium in the case of a nickel-containing alloy or steel container, or to make the siphon or container from a rare metal, e.g., tantalum, or have it treated to make it resistant to corrosion by molten tin.

BRIEF DESCRIPTION OF THE DRAWINGS

Certain elements having the same functions are given the same reference numerals in both figures of the drawings.

The examples and drawings illustrating the same relate to the means according to the invention and the operation thereof, while explaining the starting up of a pumping means according to the invention.

Figure 1:
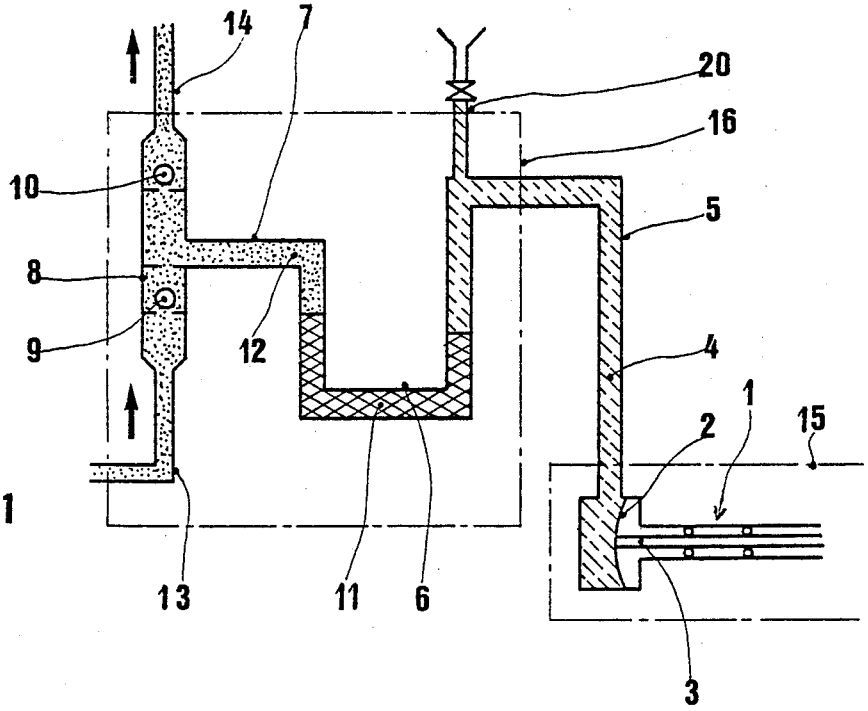
FIG. 1 is a sectional diagram of a first apparatus according to the invention having a U-shaped siphon.

FIG. 1 shows a first pumping apparatus according to the invention in its in-use state. The pulsation generator 1 is a conventional piston pump, whose flexible, Teflon-treated elastomer diaphragm 2 is operated by a piston 3. Diaphragm 2 transmits its pulsations to a thermal fluid column 4 contained in a pipe 5 connected to a siphon 6, which is itself connected by a coupling 7 to a diaphragm-free pumping head 8 between suction valve 9 and delivery valve 10. The lower part of siphon 6 is filled with molten tin 11, the tin quantity being adjusted in such a way that the siphon cannot become drained or fail. The liquid product 12 is pumped or conveyed by subjecting the portion contained in the coupling 7 to pulsations transmitted by the molten tin 11, which pulsations of the molten tin actuate the valves 9 and 10 of the pumping head 8 with suction withdrawal of the liquid product 12 from pipe 13 and the delivery of said same product into pipe 14, as indicated by the two arrows. A cooling device 15 may be necessary for keeping the pulsation generator below 100° to 120° C. An insulating cover 16 of siphon 6 and pumping head 8 is necessary for maintaining the molten tin 11 and the liquid product 12 at the correct temperature, thus preventing the liquid product or tin from locally solidifying. Thus, as a result of said means, it is possible to convey at 260° to 280° C. potassium chloroaluminate (KAlCl4) with a thermal fluid or oil with a vapor tension preferably below 0.03 MPa at said operating temperature, e.g., hydrogenated terphenyl, and with the siphon 6 containing molten tin.

In the apparatus and process according to the invention, the molten tin bath serves as an effective interface between the liquid product 12 to be pumped and the thermal fluid 4, so that in this connection it replaces the diaphragm of the known pumping means.

The siphon and pumping head according to the invention have reduced overall dimensions compared with pumping heads with metal diaphragms and with a single pumping head according to the invention there can be a flow rate of several $m^3/h$.

Figure 2:
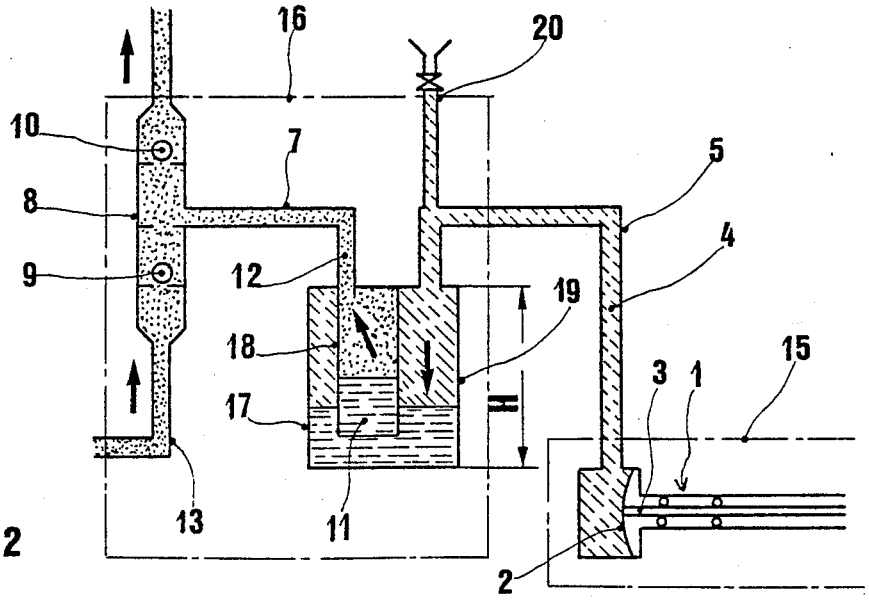
FIG. 2 is a sectional diagram of a second apparatus according to the invention having a concentric siphon.

The diagram of FIG. 2 shows a further improved apparatus for carrying potassium chloroaluminate containing dissolved hafnium and zirconium tetrachlorides. This salt solidifies at 300° to 305° C. and boils at approximately 345° C. Pumping takes place at between 315° and 330° C. using as the thermal fluid SANTOTHERM 77 (trademark). This thermal fluid has a low vapor tension, boils at above 400° C. at atmospheric pressure, is very stable at 360° to 370° C. and is liquid at ordinary temperature. The geometry of siphon 17 has been designed so as to render its heating for maintaining the temperature easier. The outlet tube 18 extending the conduit 7 is located within the annular intake chamber 19 extending the pipe 5 for the thermal fluid 4 and it has been ensured that the siphon is not very long. In general terms, the ratio of the total height (H) of siphon 17 to its external diameter or to its width is preferably between 1.3 and 2. In the example described, this ratio is 1.7 corresponding to a height (H) of 410 mm and an external diameter of 240 mm.

There are thermal insulating means 15, 16 as hereinbefore.

In operation, approximately 50 kg of molten tin 11 with a specific mass at said temperature of 6.9 $g/cm^3$ are at the bottom of the siphon, while the liquid product 12 to be pumped is located above the molten tine 11, in the height of the annular intake chamber 19, in the pipe 5 for thermal fluid 4 and above the molten tin 11 in the height of the outlet tube 18, then in coupling 7, in pumping head 8 and in pipes 13, and 14. In FIG. 2, the molten tin 11 is displaced by the thermal fluid 4 which is itself displaced by the diaphragm 2 of pulsation generator 1, while the upper surface of the tin bath in outlet tube 18 and above its inoperative position acting in the direction of the arrow, the liquid product column 12 joining the median part of the pumping head 8 via the coupling 7, said liquid product 12 then raising the balls of the intake and outlet valves 9, 10 of pumping head 8. In this way it has been possible to operate at 90 pulsations of 0.57 l/min., i.e., approximately 3078 liters of liquid product pumped per hour, the liquid product in this example being melted potassium chloroaluminate containing dissolved $ZrCl_4$ and $HfCl_4$.

A description is now given of a method of starting up the apparatus according to the invention. It is important to ensure a good prior drying of the siphone 6, 17, the pipes 5, 7, the useful volume of the pulsation head 1 and the pumping head 8, e.g by scavenging with nitrogen heated to less than 100° C. so as not to damage the diaphragm 2. The tin is introduced in the solid state (grains) or in the liquid state through an orifice 20 positioned above the branch of pipe 5, which drops towards the tube or intake chamber 19 of siphon 6, 17. The tin is then melted in the siphon and its level is inspected e.g., with the aid of a float, and its temperature is controlled. The thermal fluid is poured through the orifice 20 of a neighboring orifice and it is allowed to heat to approximately 330° C. in the siphon and to 80°/100° C., in the pipe 5 towards the pulsating head 1. The thermal fluid column 4 of specific mass approximately 0.92 $g/cm^3$ at 330° C. located above the siphon 17 forces back the tin contained in the annular chamber 19 of siphon 17, so that a level difference occurs between the tin surfaces of chamber 19 and the outlet tube 18, in the direction shown in FIG. 2. It is then possible to rebalance the tin levels by introducing a slight nitrogen pressure into the valve boxes of the pumping head 8.

The pumping apparatus and process according to the invention are more particularly applicable to the pumping of melting salts with a melting point between 200° and 350° C. and at a temperature between 210° and 380° C., taking account of the presently available thermal fluids.

I claim:

1. A process for pumping a liquid product having a melting point between about 200° and 350° C., at a temperature between about 210° and 380° C., comprising the steps of transmitting pressure and suction piston pulsation through a diaphragm to a thermal fluid, transmitting said pulsations from said thermal fluid through molten alloy in a siphon to said liquid product to be pumped in a conduit in bi-directional fluid communication with a diaphragm-free pumping head containing said fluid and having a unidirectional suction valve admitting said liquid to be pumped thereto and a unidirectional delivery valve discharging said liquid to be pumped therefrom, said molten alloy being selected from the group consisting of a Sn-Pb alloy containing Pb≦70% by weight, a Sn-Cu alloy containing Cu≦8% by weight, and a Sn-Pb-Cu alloy containing Pb≦70% and Cu≦8% by weight, whereby a pressure piston pulsation results in discharge of said liquid from said pumping head, and a suction piston pulsation results in admittance of liquid to said pumping head.

2. A process according to claim 1, additionally comprising providing a pulsation means for transmitting said piston pulsations, and thermally isolating said pulsation means from said siphon means.

3. Apparatus for pumping a liquid product having a melting point between about 200° and 350° C. at a temperature between about 210° and 380° C., comprising:

a pulsation head including a piston and a diaphragm;

a siphon means partially filled with a molten alloy selected from the group consisting of a Sn-Pb alloy containing Pb≦70% by weight, a Sn-Cu alloy containing Cu≦8% by weight, and a Sn-Pb-Cu alloy containing pb≦70% and Cu≦8% by weight;

a pumping head including a unidirectional suction valve allowing liquid flow only into said pumping head, and a unidirectional delivery valve allowing liquid flow only out of said pumping head, said pumping head having no diaphragm between said intake valve and said delivery valve;

first conduit means adapted to contain a thermal fluid and connecting said pulsation head to one side of said siphon means, said diaphragm isolating said piston from said first conduit means; and second conduit means connecting the opposite side of said siphon means to said pumping head in a manner which permits bi-directional liquid flow between said second conduit means and said pumping head.

4. Apparatus according to claim 3, including means for thermally isolating said pulsation head and said siphon means.

5. Apparatus according to claim 3, wherein said siphon means comprises an outlet tube (18) located within an annular intake chamber (19) and connected to said second conduit means.

6. Apparatus according to claim 5, wherein the ratio of the total height (H) of said siphon means (17) to its diameter or width is between 1.3 and 2.

* * * * *